US006183550B1

(12) United States Patent
Conner et al.

(10) Patent No.: US 6,183,550 B1
(45) Date of Patent: Feb. 6, 2001

(54) PAPER SIZE DISPERSIONS

(75) Inventors: Herbert Conner, Landenberg, PA (US); Tingdong Lin, Wilmington, DE (US); Gert Tuin, Apeldoorn; Henrica G. M. van de Steeg, Bennekom, both of (NL)

(73) Assignee: Hercules Incorporated, Wilmington, DE (US)

( * ) Notice: Under 35 U.S.C. 154(b), the term of this patent shall be extended for 0 days.

(21) Appl. No.: 09/293,824

(22) Filed: Apr. 16, 1999

Related U.S. Application Data

(63) Continuation-in-part of application No. 09/064,580, filed on Apr. 22, 1998, now abandoned.

(51) Int. Cl.[7] ..... D21H 17/72; D21H 17/11; D21H 17/14; D21H 17/17

(52) U.S. Cl. ..... 106/209.1; 106/210.1; 106/213.1; 106/214.1; 106/214.2; 106/215.2; 106/215.1; 106/287.2; 106/287.21; 106/287.23; 106/287.24; 106/287.25; 106/287.28; 106/287.29; 106/287.3; 162/158; 162/175

(58) Field of Search ..... 162/158, 175; 106/209.1, 210.1, 213.1, 214.1, 214.2, 215.1, 215.2, 287.2, 287.21, 287.23, 287.24, 287.25, 287.28, 287.29, 287.3

(56) References Cited

U.S. PATENT DOCUMENTS

| | | | |
|---|---|---|---|
| Re. 29,960 | 4/1979 | Mazzarella et al. | 162/158 |
| 2,524,218 | 10/1950 | Bersworth | 252/117 |
| 2,530,147 | 11/1950 | Bersworth | 260/404.5 |
| 3,223,544 | 12/1965 | Savina | 106/213 |
| 3,855,156 | 12/1974 | Marumo | 252/547 |
| 3,888,797 | 6/1975 | Marumo | 252/527 |
| 4,040,900 | 8/1977 | Mazzarella et al. | 162/158 |
| 4,240,935 | 12/1980 | Dumas | 260/9 |
| 4,243,481 | 1/1981 | Dumas | 162/158 |
| 4,279,794 | 7/1981 | Dumas | 260/29.2 EP |
| 4,295,931 | 10/1981 | Dumas | 162/158 |
| 4,317,756 | 3/1982 | Dumas | 524/607 |
| 4,407,994 | 10/1983 | Bankert et al. | 524/107 |
| 4,478,682 | 10/1984 | Bankert et al. | 162/158 |
| 4,522,686 | 6/1985 | Dumas | 162/158 |
| 4,545,856 | 10/1985 | Sweeney | 162/158 |
| 4,687,519 | 8/1987 | Trzasko et al. | 106/211 |
| 4,734,277 | 3/1988 | Login | 424/70 |
| 4,764,306 | 8/1988 | Login | 260/404.5 |
| 4,812,263 | 3/1989 | Login | 260/404.5 |
| 4,849,131 | 7/1989 | Sweeney | 252/312 |
| 4,861,376 | 8/1989 | Edwards et al. | 106/123.1 |
| 4,892,806 | 1/1990 | Briggs et al. | 430/449 |
| 4,915,786 | 4/1990 | Sweeney | 162/158 |
| 5,030,678 | 7/1991 | Hui et al. | 524/243 |
| 5,160,450 | 11/1992 | Okahara et al. | 252/174.21 |
| 5,534,197 | 7/1996 | Scheibel et al. | 510/356 |
| 5,643,864 | 7/1997 | Li et al. | 510/499 |
| 5,685,815 | 11/1997 | Bottorff et al. | 493/186 |
| 5,705,681 | 1/1998 | Steiger et al. | 560/251 |
| 5,710,121 | 1/1998 | Tracy et al. | 510/467 |
| 5,725,731 | 3/1998 | Brungardt et al. | 162/72 |
| 5,766,417 | 6/1998 | Brungardt | 162/158 |
| 5,789,371 | 8/1998 | Tracy et al. | 510/490 |
| 5,811,384 | 9/1998 | Tracy et al. | 510/424 |
| 5,846,663 | 12/1998 | Brungardt et al. | 428/537.5 |
| 5,846,926 | 12/1998 | Tracy et al. | 510/506 |
| 5,863,886 | 1/1999 | Tracy et al. | 510/470 |
| 5,879,814 | 3/1999 | Bottorff | 428/537.5 |
| 5,922,663 | 7/1999 | Gabriel et al. | 510/299 |

FOREIGN PATENT DOCUMENTS

| | | |
|---|---|---|
| 0629741A1 | 12/1994 | (EP) . |
| 884298 A2 | 12/1998 | (EP) . |
| WO 95/19955 | 7/1995 | (WO) . |
| WO 96/23768 | 8/1996 | (WO) . |
| WO 97/30218 | 8/1997 | (WO) . |
| WO 97/31890 | 9/1997 | (WO) . |
| WO 97/40124 | 10/1997 | (WO) . |
| WO 97/46513 | 12/1997 | (WO) . |
| WO 98/15345 | 4/1998 | (WO) . |
| WO 98/15346 | 4/1998 | (WO) . |
| WO 98/19783 | 5/1998 | (WO) . |
| WO 98/20853 | 5/1998 | (WO) . |
| WO 98/23365 | 6/1998 | (WO) . |
| WO 98/33982 | 8/1998 | (WO) . |
| WO 98/37062 | 8/1998 | (WO) . |
| WO 98/45308 | 10/1998 | (WO) . |

OTHER PUBLICATIONS

C.E. Farley & R.B. Wasser in "*The Sizing of Paper, Second Edition*", ed. by W.F. Reynolds, TAPPI Press, (1989), No Month Provided pp. 51–62.

"*Pulp and Paper Chemistry and Chemical Technology*", J.P. Casey editor, vol. 3, (1981), No Month Provided pp. 1553–1554.

TAPPI Standard T530 No Date Provided.

Institute for Surface Chemistry, YKI, "*Projects in the Pipeline*"(Apr., 1998) column labeled "*Gemini Surfactants*".

Rosen, M.J., *Chemtech,* (Mar., 1993) pp. 30–33.

Menger, F.M. & Littau, C.A., *J. Am. Chem. Soc.,* (1993), No Month Provided 115, pp. 10083–10090.

*Primary Examiner*—David Brunsman
(74) *Attorney, Agent, or Firm*—Martin F. Sloan

(57) ABSTRACT

Aqueous paper size dispersions comprising: a) at least one paper sizing compound, and b) a water-soluble dispersant containing at least two hydrophilic groups and at least one hydrophobic group. Processes for sizing paper utilizing the aqueous paper size dispersions, and paper made by the processes.

53 Claims, No Drawings

PAPER SIZE DISPERSIONS

This is a continuation-in-part of application Ser. No. 09/064,580, filed Apr. 22, 1998 now abandoned.

FIELD OF THE INVENTION

This invention relates to aqueous size dispersions, to methods for making sized paper utilizing the dispersions, and to paper prepared by the methods.

BACKGROUND OF THE INVENTION

Cellulose-reactive and cellulose non-reactive sizes are used widely for sizing paper during its manufacture. Because these sizes are most frequently water-insoluble, they are generally used in the form of aqueous dispersions so that they can be readily handled in the aqueous paper making environment.

Surfactants, i.e., materials typically containing both oil soluble hydrocarbon chains and water soluble polar groups, are generally not used as dispersants for paper size dispersions because they tend to exhibit an anti-sizing effect, i.e. they reduce water resistance. Conventional surfactants generally have one hydrophilic group and one hydrophobic group. Recently a class of surfactants having at least two hydrophobic groups and at least two hydrophilic groups has been introduced. These have been found to be unexpectedly effective when compared to conventional surfactants (Rosen, M. J., *Chemtech,* March, 1993, pp. 30–33; and Menger, F. M. & Littau, C. A., *J. Am Chem. Soc.,* 1993, 115, pp. 10083–10090). These have become known in the literature as "gemini surfactants".

Gemini surfactants are disclosed in U.S. Pat. Nos. 5,643,864, 5,710,121, 5,789,371, 5,811,384 and 5,863,886, the disclosures of all five of which are hereby incorporated herein by reference in their entireties. Further examples of gemini surfactants are disclosed in International Publication Nos. WO 95/19955, WO 98/15345, WO 98/15346, WO 98/23365, WO 98/37062 and WO 98/45308.

SUMMARY OF THE INVENTION

It has now been found that gemini surfactants, and certain other surfactants, are especially effective for preparing dispersions of paper sizing compounds, even when used at very low levels, providing size dispersions that produce paper with unexpectedly high sizing properties.

In one embodiment this invention relates to aqueous dispersions comprising: a) at least one paper sizing compound, and b) a water-soluble dispersant containing two or more hydrophilic groups and at least one hydrophobic group. In a preferred embodiment the water-soluble dispersant comprises a gemini surfactant containing two or more hydrophilic groups and two or more hydrophobic groups.

In another embodiment the invention relates to aqueous paper size dispersions comprising: a) a cellulose-reactive sizing agent, and b) a water-soluble dispersant comprising a di- or polyquaternary amine containing at least one hydrophobic group having from about 10 to about 30 carbon atoms.

In a yet another embodiment the invention relates to a process for preparing sized paper comprising: a) providing an aqueous paper making pulp suspension; b) sheeting and at least partially drying the aqueous pulp suspension to obtain paper; c) applying to the surface of the paper an aqueous dispersion comprising at least one paper sizing compound and a water-soluble dispersant containing at least two hydrophilic groups and at least one hydrophobic group; and d) drying to obtain sized paper. It also relates to a process for preparing sized paper comprising: a) providing an aqueous paper making pulp suspension; b) adding to the aqueous pulp solution an aqueous dispersion comprising at least one paper sizing compound and a water-soluble dispersant containing at least two hydrophilic groups and at least one hydrophobic group; and c) sheeting and drying the aqueous pulp suspension of step (b) to obtain sized paper. In yet another embodiment the invention relates to sized paper prepared by these processes.

DETAILED DESCRIPTION OF THE INVENTION

The compositions of the invention are aqueous dispersions comprising at least one paper sizing compound and a water-soluble dispersant that is a surfactant containing at least two hydrophilic groups and at least one hydrophobic group. The surfactants of the invention are water soluble and form micelles when dissolved in water above the critical micelle concentration.

Hydrophilic groups are the groups in the surfactant that promote water solubility. Hydrophobic groups are those that distort the structure of the water in which the surfactant is dissolved, and cause micelle formation and adsorption of the surfactant at the interfaces of the system. Hydrophobic groups are often alkyl or perfluoroalkyl chains.

Paper Sizing Compounds

Preferred paper sizing compounds for the invention are selected from the group consisting of cellulose reactive paper sizing compounds and cellulose non-reactive paper sizing compounds. For the purposes of this invention cellulose-reactive sizes are defined as those sizes capable of forming covalent chemical bonds by reaction with the hydroxyl groups of cellulose, and cellulose non-reactive sizes are defied as those that do not form these covalent bonds with cellulose.

Preferred cellulose-reactive sizes for use in the invention include ketene dimers and multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms.

Preferred ketene dimers and multimers are materials of formula (1), wherein n is an integer of 0 to about 20, R and R", which may be the same or different, are saturated or unsaturated straight chain or branched alkyl or alkenyl groups having 6 to 24 carbon atoms; and R' is a saturated or unsaturated straight chain or branched alkylene group having from about 2 to about 40 carbon atoms.

(1)

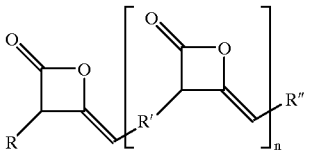

Ketene dimers for use in the process of this invention have the structure of formula (1) where n=0 and the R and R" groups, which can be the same or different, are hydrocarbon radicals. Preferably the R and R" groups are straight chain or branched alkyl or alkenyl groups having 6 to 24 carbon atoms, cycloalkyl groups having at least 6 carbon atoms, aryl groups having at least 6 carbon atoms, aralkyl groups having at least 7 carbon atoms, alkaryl groups having at least 7 carbon atoms, and mixtures thereof. More preferably, ketene dimer is selected from the group consisting of (a) octyl, decyl, dodecyl, tetradecyl, hexadecyl, octadecyl, eicosyl, docosyl, tetracosyl, phenyl, benzyl, β-naphthyl, and cyclohexyl ketene dimers, and (b) ketene dimers prepared from organic acids selected from the group consisting of montanic acid, naphthenic acid, 9,10-decylenic acid, 9,10-dodecylenic acid, palmitoleic acid, oleic acid, ricinoleic acid, linoleic acid, eleostearic acid, naturally occurring mixtures of fatty acids found in coconut oil, babassu oil, palm kernel oil, palm oil, olive oil, peanut oil, rape oil, beef tallow, lard, whale blubber, and mixtures of any of the above named fatty acids with each other. Most preferably ketene dimer is selected from the group consisting of octyl, decyl, dodecyl, tetradecyl, hexadecyl, octadecyl, eicosyl, docosyl, tetracosyl, phenyl, benzyl, β-naphthyl, and cyclohexyl ketene dimers.

Alkyl ketene dimers have been used commercially for many years and are prepared by dimerization of the alkyl ketenes made from saturated, straight chain fatty acid chlorides; the most widely used are prepared from palmitic and/or stearic acid. Neat alkyl ketene dimer is available as Aquapel® 364 sizing agent from Hercules Incorporated, Wilmington, Del. Aqueous dispersions of these materials are available as Hercon® paper sizing agents from Hercules Incorporated, Wilmington, Del.

Preferred ketene multimers for use in the process of this invention have the formula (1) where n is an integer of at least 1, R and R", which may be the same or different, are saturated or unsaturated straight chain or branched alkyl or alkenyl groups having 6 to 24 carbon atoms, preferably 10 to 20 carbon atoms, and more preferably 14 to 16 carbon atoms, and R' is a saturated or unsaturated straight chain or branched alkylene group having from 2 to 40 carbon atoms, preferably from 4 to 8 or from 28 to 40 carbon atoms.

Preferred ketene multimers are described in: European Patent Application Publication No. 0 629 741 A1, and in U.S. Pat. Nos. 5,685,815 and 5,846,663, both of which are incorporated herein by reference in their entireties.

Among the preferred ketene dimers and multimers for use in the invention are those which are not solid at 25° C. (not substantially crystalline, semi-crystalline or waxy solid; i.e., they flow on heating without heat of fusion). These liquid dimers and multimers are compounds of formula (1) in which n is preferably 0 to 6, more preferably 0 to 3, and most preferably 0; R and R", which can be the same or different, are saturated or unsaturated, straight chain or branched alkyl groups having 6 to 24 carbon atoms; R' is a saturated or unsaturated, straight chain or branched alkylene group having 2 to 40 carbon atoms, preferably 4 to 32 carbon atoms; and wherein at least 25% of the R and R" groups in the mixture of compounds is unsaturated. Preferred materials are ketene multimers, disclosed in U.S. Pat. No. 5,846,663, which is incorporated herein by reference in its entirety.

The liquid ketene dimers and multimers may comprise a mixture of ketene dimer or multimer compounds that are the reaction product of a reaction mixture comprising unsaturated monocarboxylic fatty acids. The reaction mixture may fturther comprise saturated monocarboxylic fatty acids and dicarboxylic acids. Preferably the reaction mixture for preparing the mixture of dimer or multimer compounds comprises at least about 25 wt %, more preferably about 45 wt. % and most preferably at least about 70 wt. % unsaturated monocarboxylic fatty acids.

The unsaturated monocarboxylic fatty acids included in the reaction mixture preferably have 10–26 carbon atoms, more preferably 14–22 carbon atoms, and most preferably 16–18 carbon atoms. These acids include, for example, oleic, linoleic, dodecenoic, tetradecenoic (myristoleic), hexadecenoic (palmitoleic), octadecadienoic (linolelaidic), octadecatrienoic (linolenic), eicosenoic (gadoleic), eicosatetraenoic (arachidonic), cis-13-docosenoic (erucic), trans-13-docosenoic (brassidic), and docosapentaenoic (clupanodonic) acids, and their acid halides, preferably chlorides. One or more of the monocarboxylic acids may be used. Preferred unsaturated monocarboxylic fatty acids are oleic, linoleic, linolenic and palmitoleic acids, and their acid halides. Most preferred unsaturated monocarboxylic fatty acids are oleic and linoleic acids, and their acid halides.

The saturated monocarboxylic fatty acids used to prepare the ketene dimer and multimer compounds used in this invention preferably have 10–26 carbon atoms, more preferably 14–22 carbon atoms, and most preferably 16–18 carbon atoms. These acids include, for example, stearic, isostearic, myristic, palmitic, margaric, pentadecanoic, decanoic, undecanoic, dodecanoic, tridecanoic, nonadecanoic, arachidic and behenic acids, and their halides, preferably chlorides. One or more of the saturated monocarboxylic fatty acids may be used. Preferred acids are palmitic and stearic.

The alkyl dicarboxylic acids used to prepare the ketene multimer compounds for use in this invention preferably have 6–44 carbon atoms, and more preferably 9–10, 22 or 36 carbon atoms. Such dicarboxylic acids include, for example, sebacic, azelaic, 1,10-dodecanedioic, suberic, brazylic, docosanedioic acids, and $C_{36}$ dimer acids, e.g. EMPOL® 1008 available from Henkel-Emery, Cincinnati, Ohio, and their halides, preferably chlorides. One or more of these dicarboxylic acids can be used. Dicarboxylic acids with 9–10 carbon atoms are more preferred. The most preferred dicarboxylic acids are sebacic and azelaic acids.

When dicarboxylic acids are used in the preparation of the ketene multimers for use in this invention, the maximum mole ratio of dicarboxylic acid to monocarboxylic acid (the sum of both saturated and unsaturated) is preferably about 5. A more preferred maximum is about 4, and the most preferred maximum is about 2. The mixture of dimer and multimer compounds may be prepared using methods known for the preparation of standard ketene dimers. In the first step, acid halides, preferably, acid chlorides, are formed from a mixture of fatty acids, or a mixture of faty acids and dicarboxylic acid, using $PCl_3$ or another halogenating, preferably chlorinating, agent. The acid halides are then converted to ketenes in the presence of tertiary amines (including trialkyl amines and cyclic alkyl amines), preferably triethylamine. The ketene moieties then dimerize to form the desired compounds.

Ketene dimers and multimers not solid at 25° C. are disclosed in U.S. Pat. Nos. 5,685,815, 5,846,663, 5,725,731, 5,766,417 and 5,879,814, all of which are incorporated herein by reference in their entireties. Ketene dimers not solid at 25° C. are available as Precis® sizing agents, from Hercules Incorporated, Wilmington, Del.

Also included in the group of cellulose-reactive sizes are alkenylsuccinic anhydrides (ASA). ASA's are composed of unsaturated hydrocarbon chains containing pendant succinic anhydride groups. They are usually made in a two-step process starting with alpha olefin. The olefin is first isomerized by randomly moving the double bond from the alpha position. In the second step the isomerized olefin is reacted with maleic anhydride to give the final ASA of generalized formula (2). Typical olefins used for the reaction with maleic anhydride include alkenyl, cycloalkenyl and aralkenyl compounds containing from about 8 to about 22 carbon atoms. Specific examples are isooctadecenyl succinic anhydride, n-octadecenyl succinic anhydride, n-hexadecenyl succinic anhydride, n-dodecyl succinic anhydride, i-dodecenyl succinic anhydride, n-decenyl succinic anhydride and n-octenyl succinic anhydride.

(2)

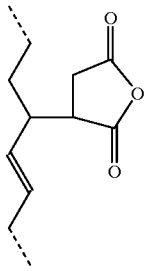

Alkenylsuccinic anhydrides are disclosed in U.S. Pat. No. 4,040,900, which is incorporated herein by reference in its entirety, and by C. E. Farley and R. B. Wasser in *The Sizing of Paper, Second Edition,* edited by W. F. Reynolds, Tappi Press, 1989, pages 51–62. A variety of alkenylsuccinic anhydrides is commercially available from Albemarle Corporation, Baton Rouge, La. Alkenylsuccinic anhydrides for use in the invention are preferably liquid at 25° C. More preferably they are liquid at 20° C.

Other preferred cellulose-reactive sizes for use in the invention are mixtures of ketene dimers or multimers with alkenylsuccinic anhydrides as described in U.S. Pat. No. 5,766,417, which is incorporated herein by reference in its entirety.

Most preferred cellulose-reactive sizes for use in the invention are ketene dimers and multimers of structure (1).

Cellulose non-reactive sizes for use in the invention preferably include unmodified rosin, fortified rosin, rosin ester, hydrogenated rosin, extended rosin, wax, hydrocarbon resins and polymeric sizes. Polymeric sizes include, but are not limited to, polyurethanes, copolymers of ethylene with comonomers such as vinyl acetate, acrylic acid and methacrylic acid, and copolymers of styrene or substituted styrenes with vinyl monomers. Examples of such vinyl monomers include, but are not restricted to maleic anhydride, acrylic acid or its alkyl esters, methacrylic acid or its alkyl esters, itaconic acid, divinyl benzene, acrylamide, acrylonitrile, cyclopentadiene and mixtures thereof.

Preferred copolymers are those made from monomers comprising styrene or substituted styrene, alkyl acrylate or methacrylate and ethylenically unsaturated carboxylic acid, where the styrene or substituted styrene is selected from the group consisting of styrene, α-methylstyrene, vinyl toluene and mixtures thereof, where the alkyl group of the alkyl acrylate or methacrylate contains from 1 to about 12 carbon atoms and where the ethylenically unsaturated carboxylic acid is selected from the group consisting of acrylic acid, methacrylic acid, maleic acid or anhydride, fumaric acid, itaconic acid and mixtures thereof. These copolymers are described in copending patent application Ser. No. 08/847,841 filed Apr. 28, 1997, which is incorporated herein by reference in its entirety. A preferred example of these copolymers is Chromaset® 600 surface sizing treatment, available from Hercules Incorporated, Wilmington Del. Examples of other commercially available water-insoluble polymers are: Carboset® 1086, a poly(styrene/acrylic acid/2-ethylhexyl acrylate) latex, available from B. F. Goodrich Co., Akron, Ohio; Basoplast® 250D, a latex of poly (acrylonitrile/butyl acrylate), available from BASF Corporation, Charlotte, N.C.; Jetsize® Plus, a cationic poly (styrene/acrylate) latex, available from Eka-Nobel, Marietta, Ga.; Flexbond® 381, poly(ethylene/vinyl acetate) latex, available from Air Products Corporation, Allentown, Pa.; and Flexbond® 325, poly(ethylene/vinyl acetate) latex, also available from Air Products Corporation.

Water-Soluble Dispersants

Water-soluble dispersants for the invention contain at least two hydrophilic groups and at least one hydrophobic group. A preferred group of water-soluble dispersants are di- or polyquaternary amines containing at least one hydrophobic group having from about 10 to about 30 carbon atoms.

Materials of this class may have structures of any of formulas (3)–(6).

(3)

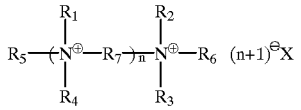

(4)

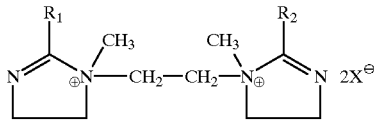

(5)

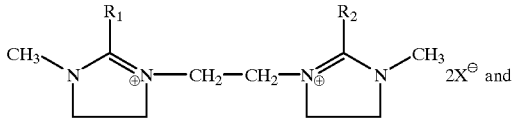

(6)

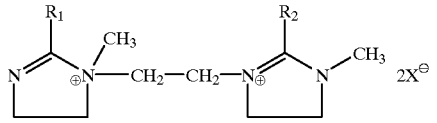

where $R_1$ is a $C_{10}$ to $C_{30}$ alkyl, alkenyl, cycloalkyl, alkaryl or aralkyl group, $R_2$, $R_3$, $R_4$, $R_5$ and $R_6$, which may be the same or different, are $C_1$ to $C_{30}$ alkyl, alkenyl, cycloalkyl alkaryl or aralkyl groups; $R_7$ is a $C_1$ to $C_{30}$ alkylene, alkenylene, cycloalkylene, alkarylene, or aralkylene group, or the hydroxide, acyloxy, chloride or bromide substitution products thereof; n is from 1 to 15; and x is an anion selected from the group consisting of chloride, fluoride, bromide, nitrate, sulfate and alkyl sulfonate.

More preferably the dispersants have the structure of formula (3). Even more preferred are dispersants of formula (3) where n is from 1 to about 5, $R_1$ is $C_{10}$–$C_{30}$ alkyl, $R_2$ is methyl or $C_{10}$–$C_{30}$ alkyl, and $R_7$ is 1,3-propylene or 2-hydroxy-1,3-propylene. Most preferred are materials of formula (3) where n is 1, $R_7$ is 2-hydroxypropylene, $R_1$ and $R_2$ are $C_{18}$ alkyl groups and $R_3$, $R_4$, $R_5$ and $R_6$ are methyl groups, or where n is 1, $R_7$ is trimethylene, $R_1$ is a mixture of $C_{14}$ to $C_{18}$ alkyl groups and $R_2$, $R_3$, $R_4$, $R_5$ and $R_6$ are methyl groups. This most preferred cationic gemini surfactant has the structural formula (7).

(7)

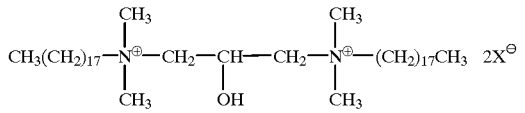

The compound with the structural formula (7) where X is chloride is also known as 2-hydroxypropylene-1,3-bis (dimethyl stearyl ammonium chloride). Methods for its preparation are described in U.S. Pat. Nos. 4,734,277, 4,764, 306 and 4,812,263, all three of which are incorporated herein by reference in their entireties. 2-Hydroxy propylene-1,3-bis(dimethyl stearyl ammonium chloride) is available from BASF, Inc., Mount Olive, N.J., as M-Quat® Dimer 18.

Another preferred surfactant of this type has formula (8) where R is a $C_{14}$–$C_{18}$ alkyl group and X is an anion selected from the group consisting of chloride, fluoride, bromide, nitrate and alkyl sulfonate. Material of formula (8), also known as N-tallow pentamethyl propane diammonium dichloride, when X is chloride, is available as Adogen® 477 from Witco Corp., Greenwich, Conn.

(8)

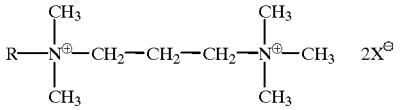

A preferred group of gemini surfactants for use in the invention comprises those with the structure of formula (9):

(9)

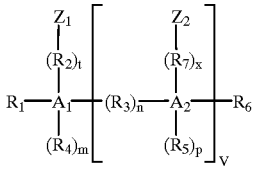

where n is a number from 0 to about 15; m, p, t and x are either 0 or 1; and v is a number 1 to about 15;

where $R_1$, $R_4$, $R_5$, and $R_6$, which may be the same are different, are selected from the group consisting of hydrogen, $C_1$–$C_{30}$ alkyl, alkenyl, cycloalkyl, cycloalkenyl, and aralkyl groups, and at least one of $R_1$, $R_4$, $R_5$, and $R_6$ contains from about 10 to about 30 carbon atoms;

where $R_2$ and $R_7$, which may be the same or different, are selected from the group consisting of: (a) $C_1$–$C_{10}$ alkylene; (b) axylene; (c) oxygen; (d) —C(O)N($R_8$)—; (e) —[—O $(EO)_a(PO)_b$]— wherein EO represents ethylene oxy radical, PO represents propylene oxy radical, a and b are numbers from 0 to about 100, the sum of a and b is at least 1, and the EO and PO radicals are randomly mixed or in discrete blocks; (f) $R_9$-D-$R_{10}$; and (g) -D-$R_9$-D-, where $R_9$ and $R_{10}$, which may be the same or different, are $C_1$–$C_6$ alkylene and D is oxygen, sulfur, —[C(CO)N($R_8$)]— or —N($R_8$)— where $R_8$ is hydrogen or $C_1$–$C_6$ alkyl groups;

where $R_3$ is selected from the group consisting of arylene, $C_1$–$C_{10}$ alkylene, —O—, —S—,, —S—S—, —N($R_8$)—, —$R_{11}$O—, —$R_{11}$[O(EO)$_a$(PO)$_b$]—, -D-$R_9$-D- and $R_9$-D-$R_{10}$, wherein $R_8$, $R_9$, $R_{10}$, EO, PO, a, b and D are as defined above, and $R_{11}$ is $C_1$–$C_{12}$ alkylene;

where $A_1$ and $A_2$, which may be the same or different, are selected from the group consisting of $N^+$, $C_1$–$C_{10}$ alkyl, —O—$R_{11}$—O—, and aryl, wherein $R_{11}$ is as defined above;

where $Z_1$ and $Z_2$, which may be the same or different, are selected from the group consisting of hydrogen and anionic, cationic and non-ionic hydrophilic groups; and wherein when $Z_1$ and $Z_2$ are both hydrogen, $A_1$ and $A_2$ are both $N^+$, and when one of $Z_1$ and $Z_2$ is hydrogen, at least one of $A_1$ and $A_2$ is a hydrophilic group.

Gemini surfactants of formula (9) may be non-ionic, anionic, cationic or amphoteric depending essentially on the identity of hydrophilic groups $Z_1$ and $Z_2$ which may be non-ionic, anionic or cationic. If one of $Z_1$ and $Z_2$ is anionic and the other cationic, then the gemini surfactant is amphoteric. Anionic and cationic gemini surfactants are preferred, and cationic are most preferred. Preferred anionic groups for use as $Z_1$ and $Z_2$ are —$SO_3$Y, —P(O)(OY)$_2$, —COOY, —$CH_2$COOY, —$CH_2$CH(OH)$CH_2SO_3$Y, —$OSO_3$Y and —OP(O)(OY)$_2$, where Y is selected from the group consisting of hydrogen, alkali metal, alkaline earth metal and organic amine salt. Most preferred anionic groups are —$SO_3$Y and —COOY, where Y is an alkali metal.

Preferred cationic hydrophilic groups for use as $Z_1$ and $Z_2$ are those with the formula —$N^+(R)_3$,, where the R's, which may be the same or different, are $C_1$–$C_{22}$ alkyl groups.

Preferred non-ionic hydrophilic groups for use as $Z_1$ and $Z_2$ are those with the formula —O$(EO)_a(PO)_b$—B, where EO represents ethylene oxy radical, PO represents propylene oxy radical, a and b are numbers from 0 to about 100, the sum of a and b is at least 1, the EO and PO radicals are randomly mixed or in discrete blocks, and B is a hydrogen, a $C_1$–$C_{22}$ alkyl group or an acyl group.

Examples of typical anionic gemini surfactants are disclosed in U.S. Pat. Nos. 5,160,450, 5,643,864 and 5,710, 121, all of which are incorporated herein by reference in their entireties, and in International Patent Application Publication Nos. WO 97/40124, W097/46513, WO 98/15345, WO 98/20853, WO 98/23365, WO 98/37062 and WO 98/45308.

Examples of non-ionic gemini surfactants are disclosed in U.S. Pat. Nos. 5,811,384, 5,846,926 and 5,863,886, all of which are incorporated herein by reference in their entireties, and in International Patent Application Publication Nos. WO 95/19955, WO 98/15345, WO 98/19783, WO 98/23365, 98/37062 and 98/45308.

Typical amphoteric gemini surfactants are disclosed in International Patent Application Publication No. WO 97/31890.

A preferred class of anionic gemini surfactants for use in the invention is represented by formula (9) above where $R_1$ and $R_6$ are hydrogen, $R_3$ is —O—, $R_4$ and $R_5$ are $C_1$–$C_{30}$ alkyl, n is 1, m and p are 0,1 or 2, m+p is 2, t and x are 0, $A_1$ and $A_2$ are phenyl, $Z_1$ and $Z_2$ are —$SO_3$M, where M is selected from the group consisting of lithium, sodium and potassium ions. Gemini surfactants of this class are available as Dowfax® emulsifiers from The Dow Chemical Co., Midland, Mich.

Particularly preferred members of this class have the formula (10):

(10)

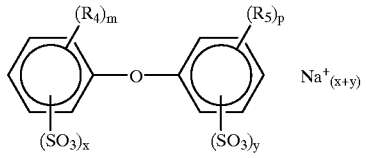

wherein $R_4$and $R_5$are $C_1$–$C_{30}$ alkyl, m and p are 0, 1 or 2, m+p is 2, x and y are 0 or 1 and x+y is or 2.

In addition to cationic gemini surfactants of structure (9), other preferred cationic gemini surfactants are selected from the group consisting of any of formulas (3)–(8) described above.

The aqueous dispersions of the invention are prepared by conventional methods, using either high or low shear techniques well known in the papermaking art The levels of cellulose-reactive size and dispersant in the aqueous dispersions of the invention depend in part on the particular cellulose-reactive size used, the particular dispersant used and the intended application. Preferably the level of cellulose-reactive size is from about 1 to about 50, and more preferably from about 5 to about 20 wt. % on a dry basis based on the total weight of the dispersion. The gemini surfactant is preferably used at minimum levels of about 0.0001 wt. % based on the total weight of the dispersion. A more preferred minimum level is about 0.001 wt. %. An even more preferred minimum level is 0.01 wt. %, and the most preferred minimum level is about 0.1 wt. %. A preferred maximum level for the gemini surfactant is about 20 wt. % based on the total weight of the dispersion. A more preferred maximum level is about 10 wt. %; an even more preferred maximum level is about 5 wt. %, and the most preferred maximum level about 3 wt.%.

The paper size dispersions of the invention may also contain starch or modified starch as dispersion stabilizers. The starch may be of any water-soluble type, including but not limited to oxidized, ethylated, cationic, lipophilic and pearl starch, and is preferably used in aqueous solution. Preferably the starches are cationic starches, and more preferably they are cationic waxy maize starches with either tertiary or quaternary amino groups as the source of the cationic charge. Starches with a Brookfield viscosity range of about 1 to about 2,000 cps (10 wt. % solution in water, #2 spindle, 100 rpm at 38° C.) are preferred. Starch is present in the aqueous size dispersions of the invention at levels of from 0 to about 20 wt. % on a dry basis based on the total weight of the dispersion. More preferable levels are from about 0.1 to about 5 wt. %, and most preferable levels from about 0.3 to about 3 wt. %.

Additional ingredients commonly used in paper making and/or paper size dispersions may also be included in the aqueous dispersions. Examples of such materials are biocides, alum, clay, calcium carbonate, titanium dioxide, sodium lignin sulfonate, nonionic surfactants, optical brighteners, retention and drainage aids, etc., all of which may be used in their normal ranges.

In addition to the above, other anionic, cationic or nonionic dispersants ordinarily useful for making size dispersions may be used in conjunction with the dispersants described herein.

The paper size dispersions of the invention may be used in internal sizing where the dispersions, along with other paper making ingredients, are added to the pulp slurry in the wet end of the paper making process, followed by formation of the sheet and drying. They may also be used in surface sizing, where they are applied to the surface of the paper from a size press after the sheet is formed and at least partially dried. The size press can be any type of coating or spraying equipment, but most commonly is a puddle, gate roller or metered blade type of size press. Furthermore, it is common practice to effect sizing both internally and at the size press.

When internal sizing is employed, it is usually desired that the size dispesion have a significant positive charge to increase the retention and interaction of the size with the negatively charged paper pulp. Addition of cationic starch, other cationic colloidal polymers, alum or other cationic dispersants or resins may be used to increase the cationic charge level. For surface sizing, the preferred charge level on the size dispersion may depend on the particular sizing compounds that are used. Cationic charge may be increased as described above for internal sizing. Anionic charge may be increased by addition of oxidized starch or other anionic starches or anionic colloidal polymers, as well as by conventional anionic dispersants ordinarily used for paper sizes.

The paper of this invention is preferably sized at a level of at least 0.5 lb/ton, more preferably at least about 1.5 lb/ton, and most preferably at least about 2.2 lb/ton.

The aqueous pulp suspensions used in the processes of the invention are obtained by means well known in the art, such as known mechanical, chemical and semichemical, etc., pulping processes. Normally, after the mechanical grinding and/or chemical pulping step, the pulp is washed to remove residual pulping chemicals and solubilized wood components. Either bleached or unbleached pulp fiber may be utilized in the process of this invention. Recycled pulp fibers are also suitable for use.

The sheeting and drying of the pulp suspension is also carried out by methods well known in the art. There is a variety of materials which in the commercial practice of making paper are commonly add to the aqueous pulp suspension before it is converted into paper, and may be used in the instant processes as well. These include, but are not restricted to, wet strength resins, internal sizes, dry strength resins, retention aids, alum, fillers, pigments and dyes.

Paper sized using the paper size dispersions disclosed herein exhibits significantly higher levels of sizing than those obtained for paper that is essentially the same, i.e., sized with cellulose-reactive size at substantially the same level, except that the size is applied using an aqueous dispersion that does not contain the water-soluble dispersants of this invention. For example, when sizing is measured by the Hercules Sizing Test (HST), where longer times correlate with higher sizing, sizing time values from about 20 to about 100% higher are found for paper sized with the sizing compositions of this invention.

This invention is illustrated by the following examples, which are exemplary only and not intended to be limiting. All percentages, parts, etc., are by weight, unless otherwise indicated.

Procedures

Hercules Size Test:

The Hercules Size Test, an art-recognized test for measuring sizing performance, is described in *Pulp and Paper Chemistry and Chemical Technology,* J. P. Casey, Ed., Vol. 3, p. 1553–1554 (1981) and in TAPPI Standard T530. The Hercules Size Test determines the degree of water sizing obtained in paper by measuring the change in reflectance of the paper's surface as an aqueous solution of dye penetrates from the opposite surface side. The aqueous dye solution, e.g., naphthol green dye in 1% formic acid, is contained in a ring on the top surface of the paper, and the change in reflectance is measured photoelectrically from the bottom surface.

Test duration is limited by choosing a convenient end point, e.g., a reduction in reflected light of 20%, corresponding to 80% reflectance. A timer measures the time (in seconds) for the end point of the test to be reached. Longer times correlate with increased sizing performance, i.e., resistance to water penetration increases.

Materials

Dispersants

2-Hydroxy propylene-1,3-bis(dimethyl stearyl ammonium chloride): available as M-Quat® Dimer 18 from BASF Inc., Mount Olive, N.J.

N-tallow pentamethyl propane diammonium dichloride: available as Adogen® 477 from Witco Corp., Greenwich, Conn. Dowfax® dispersants: Dowfax® 8390D from Dow Chemical Co., Midland, Mich.

Cellulose-reactive Sizes

Alkyl ketene dimer (AKD): Aquapel® 364 sizing agent from Hercules Incorporated, Wilmington, Del.

Control alkyl ketene dimer aqueous dispersion: Hercon® 70 reactive size from Hercules Incorporated, Wilmington, Del. Hercon® 70 is a cationic aqueous dispersion of alkyl ketene dimer at a total solids level of about 12.5 wt. %.

EXAMPLE 1

This example illustrates preparation of alkyl ketene dimer dispersions using 2-hydroxy propylene-1,3-bis(dimethyl stearyl ammonium chloride) as the dispersant.

M-Quat® Dimer 18 was dissolved in an appropriate amount of water, and the resulting solution was warmed to 80° C. Then molten AKD was added while stirring at 1,000 rpm. Stiring was continued for 5 minutes at 80° C., and then the mixture was further dispersed by applying ultrasonic energy from a Branson 350 Sonifier® set at power of 6, cycle equal to 50%, using a 1.9 cm (¾ inch) sonifier tip. During sonication the dispersion was magnetically stirred at 55° C. After the sonication the dispersion was immediately cooled to 20–30° C., at which point there was added biocide, AMA-415, available from Vinings Industries, Marietta, Ga. The dispersions prepared in this manner are described in Table 1.

TABLE 1

| Ingredients | Example 1A | Example 1B |
|---|---|---|
| Water | 89.40 pph | 88.43 pph |
| M-Quat ® Dimer 18 | 0.50 | 1.50 |
| AKD | 10.02 | 10.01 |
| Biocide | 0.06 | 0.06 |

EXAMPLE 2

This example describes the preparation of surface sized paper using the size dispersions prepared in Example 1.

The paper used for the test was standard waterleaf paper consisting of mixed hardwood and softwood pulps with no chemical additives.

The size dispersions of Example 1 were added to a 5% solution of D-150 oxidized starch (Grain Processing Corporation, Muscatine, Iowa) in an amount sufficient to provide AKD at 0.125 wt. % in the starch solution. The test sheets of the paper were then run through a wet nip of a laboratory puddle size press containing the AKD dispersion, and then dried on a drum drier at 104° C. for 20 seconds. Application levels were determined by correcting the nip concentration of the size for weight of liquid picked up by the paper as it went through the nip. The size level in the dry paper was 0.05 wt. %. A control, or comparative sample, was prepared using Hercon® 70 reactive size dispersion.

The resulting paper samples were tested for sizing using the Hercules Sizing Test after aging for 48 hours at 25° C. The results were as follows.

| Size Designation | 1A | 1B | Hercon ® 70 |
|---|---|---|---|
| HST, seconds | 621.8 | 854.8 | 619.3 |

These data show that both of experimental size dispersions outperform the control Hercon® 70 control. This is particularly the case when M-Quat® Dimer 18 is present in the aqueous size dispersion at the higher level.

EXAMPLE 3

This example illustrates aqueous size dispersions containing M-Quat® Dimer 18 as the dispersant and starch as a stabilizer. The starch used was Mira-Cap® starch, a lipophilic, modified waxy corn starch, available from A. E. Staley Manufacturing Co., Decatur, Ill. The method of preparation was the same as that described for Example 1.

The dispersion formulations are described in Table 2. In each case, after preparation of the dispersions, biocide at 0.06 pph was added.

TABLE 2

| Ingredients | Example 3A | Example 3B | Example 3C | Example 3D |
|---|---|---|---|---|
| Water | 88.8 pph | 87.44 pph | 87.81 pph | 86.44 pph |
| M-Quat ® Dimer 18[1] | 0.5 | 0.5 | 1.50 | 1.5 |
| AKD | 10.00 | 10.00 | 10.00 | 10.00 |
| Mira-Cap ® starch[2] | 0.67 | 2.00 | 0.67 | 2.00 |

[1]Added as 10% solution in water
[2]Added as 20% solution in water

EXAMPLE 4

In this example the aqueous size dispersions of Example 3 were used to surface size paper using the procedures described in Example 2. Control paper was prepared using Hercon® 70 paper sizing dispersion. The size level was 0.14 wt % based on the dry weight of the paper. The sizing results were as follows:

| Size Designation | 3A | 3B | 3C | 3D | Hercon ® 70 |
|---|---|---|---|---|---|
| HST, seconds | 810.6 | 947.1 | 929.2 | 711.8 | 619.3 |

These results demonstrate that the formulations of the invention outperform the control by as much as 53%.

EXAMPLE 5

In Examples 1 and 3 the dispersions were prepared by sonication. This example demonstrates use of a high pressure impingement mixer to make the dispersions.

Alkyl ketene dimer and M-Quat® Dimer 18 were melted together with magnetic stiring at 60° C. for 10 minutes. Then water at 75° C. was added with stiffing, and string was continued at 60° C. for an additional 10 minutes. Then the mixture was passed through a Model M-110F microfluidizer from Microfluidics Corporation, operated with pressurized air at 5.6 kg/cm$^2$ (80 psi). The first and last 20 ml of the dispersions were discarded. The resulting dispersions were cooled to below 30° C. After preparation of the dispersions, biocide at 0.05 to 0.06 pph was added to each. The ingre dient compositions used for each dispersion are presented in Table 3.

TABLE 3

| Ingredient | Example 5A | Example 5B | Example 5C |
|---|---|---|---|
| Water | 89.53 pph | 89.07 pph | 88.60 pph |
| AKD | 9.46 | 9.46 | 9.46 |
| M-Quat ® Dimer 18 | 0.95 | 1.42 | 1.89 |
| Biocide | 0.06 | 0.05 | 0.05 |

For testing of dispersion stability, a portion of each was stored at 32° C. for the time indicated in Table 4 below. Dispersions were considered to have failed if they separated or if their viscosities increased significantly within the period of aging. As shown in Table 4, none of the dispersions showed signs of failure during the test.

TABLE 4

| | Viscosity (cps) | | |
|---|---|---|---|
| | Example 5A | Example 5B | Example 5C |
| As made | 2.3 | 2.3 | 2.5 |
| 2 weeks at 32° C. | 3.2 | 3.3 | 4.7 |
| 4 weeks at 32° C. | 3.5 | 4.0 | 5.6 |

EXAMPLE 6

In this Example the procedure of Example 1 was used to prepare dispersions containing Sta-Lok® 169 starch, available from A. E. Staley Manufacturing Co., Decatur, Ill., as an additional ingredient. For the procedure, the starch was made into a 5% aqueous solution by cooking it in water at 95° C. for 30 minutes at pH 4.5–6.0. The dispersions prepared are described in Table 5. After preparation of the dispersions, biocide at 0.06 pph was added to each.

TABLE 5

| | Example 6A | Example 6B |
|---|---|---|
| Water | 87.77 pph | 78.41 pph |
| Sta-Lock ® 169 | 1.25 | 0.65 |
| M-Quat ® Dimer 18 | 1.00 | 0.51 |
| Adogen ® 477 | — | 0.52 |
| AKD | 10.00 | 20.00 |

EXAMPLE 7

In this example the aqueous dispersions prepared in Example 6, and Hercon® 70 paper sizing dispersion control were used to prepared internally sized paper on a pilot paper machine. The paper was made at pH 7 from a 70:30 blend of hardwood and softwood pulps beaten to a Canadian standard freeness of 525 and formed into sheets having a basis weight of 65.1 g/m$^2$. The size dispersions were added to the stock just prior to dilution at the fan pump. The addition level was 0.10% AKD on a dry basis based on the dry paper weight. Also added to the stock were Sta-Lok® 400 starch at the 0.50% level, and Reten® 1523H retention aid (available from Hercules Incorporated, Wilmington, Del.) at the 0.025% level. The paper sheets were dried to 5% moisture at the reel.

Hercules Sizing Tests were performed at 50% relative humidity and 22° C. after aging for 6 days at room temperature. The sizing data were as follows.

| Size Designation | 6A | 6B | Hercon ® 70 |
|---|---|---|---|
| HST, seconds | 3,970 | 3,630 | 2,978 |

The data indicate that the dispersions of the invention are a significant improvement over the control.

EXAMPLE 8

In this example the paper making of Example 7 was repeated. However, 1.5% of sodium lignin sulfonate was added to the pulp stock to simulate anionic contaminates of typical recycled wood pulps. All other ingredients and conditions were the same. The sizing data were as follows:

| Size Designation | 6A | 6B | Hercon ® 70 |
|---|---|---|---|
| HST, seconds | 2,939 | 3,188 | 1,563 |

In this case also the dispersions of the invention outperformed the commercial control.

EXAMPLE 9

This example illustrates preparation of a ketene dimer dispersion using anionic gemini dispersant of formula (10) where $R_4$ and $R_5$ are $C_{16}$ alkyl, and m, p, x and y are 1.

Nine grams of anionic dispersant Dowfax® 8390D, available from Dow Chemical Co., Midland Mich., and 1,749.8 of water were added to a jet cooker. The mixture was stirred until the Dowfax® 8390D was completely dissolved, and then the cooker was heated to 70° C. At this point 200 g of an alkyl ketene dimer, Aquapel® 364 paper size, from Hercules Incorporated, Wilmington, Del., and 1.2 g biocide AMA® 424, from Vinings Industries, Georgia, were added. The resulting mixture was stirred for 10 minutes at 70° C., and then the mixture was homogenized under pressure of 211 kg/cm$^2$ with a 15 M Gaulin Laboratory Homogenizer made by Gaulin Corporation, Massachusetts, and then rapidly cooled to 25° C. After the dispersion had been aged for 24 hours at 25° C., 490 g was taken and 10 g of 5% aluminum sulfate solution was added with stirring. The Brookfield viscosity (Brookfield DV-II Viscometer, #1 spindle, 60 rpm) of the dispersion was 1.7 cps. After the dispersion has been aged for 4 weeks at 32° C. the viscosity was 1.2 cps.

EXAMPLE 10

In this example the aqueous dispersions prepared in Example 9, and Hercon® 70 paper sizing dispersion control were used to prepared internally sized paper on a pilot paper machine. The paper was made at pH 7.7 from a 70:30 blend of Crown Vantage Burgess hardwood kraft and Rayonier bleached kraft pulps. The pulp was beaten to a Canadian standard freeness of 420 and formed into sheets having a basis weight of 65.1 g/m$^2$. The size dispersions were added to the thick stock just prior to dilution at the fan pump at an addition level calculated to ketene dimer at a level of 0.2% based on the dry weight of the paper. Also added were Sta-lok® 400 cationic starch (available from A. E. Staley Manufacturing Co., Decatur, Ill.) at the 0.75% level, alum at the 0.1% level, and Reten® 235 retention aid (available from Hercules Incorporated, Wilmington, Del.) at the 0.01% level. After forming and drying of the sheets, the level of sizing was determined using the Hercules Sizing Test (HST). The results are in the table below. These results indicate a somewhat higher sizing level for the dispersion of the invention as compared to the Hercon® control.

| Size Designation | Example 9 | Hercon ® 70 |
|---|---|---|
| HST, seconds | 298 | 283 |

EXAMPLE 11

This example illustrates the preparation of a dispersion of fortified rosin with 2-hydroxy propylene-1,3-bis(dimethyl stearyl ammonium chloride), M-Quat® Dimer 18, as the dispersant.

A 1% (w/w) solution of M-Quat® Dimer 18 in water was prepared. Tall oil rosin fortified by reaction with fumaric acid (8% combined fumaric acid) was dissolved in methyl t-butyl ether (MTBE) to obtain 50% (w/w) solution.

To 200 gram of the 1% M-Quat solution in water, 60 gram of the 50/50 w/w solution of fortified rosin in MTBE was added. A coarse rosin emulsion was prepared by using a high speed stirrer (Ultra-thurrax, IKA Labortechnik) for 1 minute at the highest speed. The coarse emulsion was then further dispersed by applying ultrasonic energy from a Branson VCX-600 sonifier set at 50% amplitude using a 1.2 cm tip for 3 minutes.

The MTBE solvent was evaporated from the dispersion using a thin film evaporator, and the solids content of the dispersion was determined and found to be 12.58 %. The Brookfield viscosity at 60 rpm was lower than 10 mPa.s. The dispersion was then placed in a 32° C. oven and the viscosity of the dispersion was measured on a regular base. Dispersions are considered to fail in this aging test, if the viscosity of the dispersion increases considerably (a viscosity higher than 200 mPa.s) or separation (the formation of distinctly observable layers) occurs within the period of aging.

After 6 months of storage the viscosity of the dispersion was still lower than 10 mPa.s, and no signs of separations were observed. The dispersion is considered to be very stable.

EXAMPLE 12

This example illustrates the stability of paper size dispersions prepared using a gemini surfactant at a low level.

Aquapel® 364 sizing agent (100 g) was melted at about 70° C. and combined with 197 g of deionized water and 3 g of 1% total solids M-Quat® Dimer 18. The resulting mixture was dispersed using a Tecmar SD45 Ultra Turax rotor stator mixer (Tekmar Corporation, Cincinnati, Ohio) for 2 minutes at a setting of 50. The resulting dispersion was then further dispersed in 2 passes in Microfluidizer (Microfluidics Corporation, Newton, Mass.) at 352 kg/cm$^2$ (5,000 psi), 70° C. The resulting dispersion was then cooled to 20° C. The viscosity after preparation was 22 cps (Brookfield Viscometer, #2 spindle, 60 rpm). The median particle size was 0.63 microns.

The dispersion was stored at 32° C. and tested for particle size and viscosity. After 14 days the viscosity was 44 cps and the median particle size was 0.88 microns, indicating suitable commercial stability.

It is not intended that the examples presented here should be construed to limit the invention, but rather they are submitted to illustrate some of the specific embodiments of the invention. Various modifications and variations of the present invention can be made without departing from the scope of the appended claims.

The entire disclosure of application Ser. No. 09/064,580 is considered as being part of the disclosure of this application, and the entire disclosure of application Ser. No. 09/064,580 is expressly incorporated by reference herein in its entirety.

What is claimed is:

1. An aqueous dispersion comprising:

a) at least one paper sizing compound, and b) a water-soluble dispersant containing at least two hydrophilic groups and at least one hydrophobic group.

2. The aqueous dispersion of claim 1 wherein the paper sizing compound is at least one material selected from the group consisting of cellulose reactive sizes and cellulose non-reactive sizes.

3. The aqueous dispersion of claim 1 wherein the at least one hydrophobic group has from about 10 to about 30 carbon atoms.

4. The aqueous dispersion of claim 1 wherein the water-soluble dispersant comprises a gemini surfactant containing two or more hydrophilic groups and two or more hydrophobic groups.

5. The aqueous dispersion of claim 4 wherein the hydrophilic groups are selected from the group consisting of anionic, cationic and nonionic hydrophilic groups.

6. The aqueous dispersion of claim 4 wherein the hydrophobic groups contain from about 10 to about 30 carbon atoms.

7. The aqueous dispersion of claim 4 wherein the gemini surfactant comprises material of formula (9):

(9)

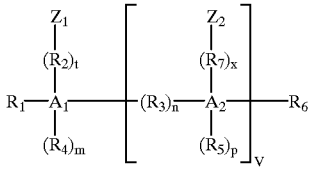

where n is a number from 0 to about 15; m, p, t and x are either 0 or 1; and v is a number 1 to about 15;

where $R_1$, $R_4$, $R_5$, and $R_6$, which may be the same are different, are selected from the group consisting of hydrogen, $C_1$–$C_{30}$ alkyl, alkenyl, cycloalkyl, cycloalkenyl, and aralkyl groups, and at least one of $R_1$, $R_4$, $R_5$, and $R_6$ contains from about 10 to about 30 carbon atoms;

where $R_2$ and $R_7$, which may be the same or different, are selected from the group consisting of: (a) $C_1$–$C_{10}$ alkylene; (b) arylene; (c) oxygen; (d) —C(O)N($R_8$)—; (e) —[—O(EO)$_a$(PO)$_b$]— wherein EO represents ethylene oxy radical, PO represents propylene oxy radical, a and b are numbers from 0 to about 100, the sum of a and b is at least 1, and the EO and PO radicals are randomly mixed or in discrete blocks; (f) $R_9$-D-$R_{10}$; and (g) -D-$R_9$-D-, where $R_9$ and $R_{10}$, which may be the same or different, are $C_1$–$C_6$ alkylene and D is oxygen, sulfur, —[C(CO)N($R_8$)]— or —N($R_8$)—, where $R_8$ is hydrogen or $C_1$–$C_6$ alkyl groups;

where $R_3$ is selected from the group consisting of arylene, $C_1$–$C_{10}$ alkylene, —O—, —S—,, —S—S—, —N($R_8$)—, —$R_{11}$O—, —$R_{11}$[O(EO)$_a$(PO)$_b$]—, -D-$R_9$-D- and $R_9$-D-$R_{10}$, wherein $R_8$, $R_9$, $R_{10}$, EO, PO, a, b and D are as defined above, and $R_{11}$ is $C_1$–$C_{12}$ alkylene;

where $A_1$ and $A_2$, which may be the same or different, are selected from the group consisting of $N^+$, $C_1$–$C_{10}$ alkyl, —O—$R_{11}$—O—, and aryl, wherein $R_{11}$ is as defined above;

where $Z_1$ and $Z_2$, which may be the same or different, are selected from the group consisting of hydrogen and anionic, cationic and non-ionic hydrophilic groups; and wherein when $Z_1$ and $Z_2$ are both hydrogen, $A_1$ and $A_2$ are both $N^+$, and when one of $Z_1$ and $Z_2$ is hydrogen, at least one of $A_1$ and $A_2$ is a hydrophilic group.

8. The aqueous dispersion of claim 7 wherein at least one of $Z_1$ and $Z_2$ is an anionic hydrophilic group selected from the group consisting of —$SO_3Y$, —$P(O)(OY)_2$, —COOY, —$CH_2$COOY, —$CH_2CH(OH)CH_2SO_3Y$, —$OSO_3Y$ and —$OP(O)(OY)_2$, wherein Y is selected from the group consisting of hydrogen, alkali metal, alkaline earth metal and organic amine salt.

9. The aqueous dispersion of claim 7 wherein at least one of $Z_1$ and $Z_2$ is a cationic hydrophilic group —$N^+(R)_3$, wherein the R's, which may be the same or different, are $C_1$–$C_{22}$ alkyl groups.

10. The aqueous dispersion of claim 7 wherein at least one of $Z_1$ and $Z_2$ is a non-ionic hydrophilic group —$O(EO)_a(PO)_b$—B, where EO represents ethylene oxy radical, PO represents propylene oxy radical, a and b are numbers from 0 to about 100, the sum of a and b is at least 1, and the EO and PO radicals are randomly mixed or in discrete blocks, and where B is hydrogen, a $C_1$–$C_{22}$ alkyl group or an acyl group.

11. The aqueous dispersion of claim 7 wherein $R_1$ and $R_6$ are hydrogen, $R_3$ is —O—, $R_4$ and $R_5$ are $C_1$–$C_{30}$ alkyl, n is 1, m and p are 0,1 or 2, m+p is 2, t and x are 0, $A_1$ and $A_2$ are phenyl, $Z_1$ and $Z_2$ are —$SO_3M$, where M is selected from the group consisting of lithium, sodium and potassium ions.

12. The aqueous dispersion of claim 11 wherein $R_4$ and $R_5$ are $C_{18}$ alkyl and M is sodium ion.

13. The aqueous dispersion of claim 4 wherein the paper sizing compound is at least one material selected from the group consisting of cellulose reactive sizes and cellulose non-reactive sizes.

14. The aqueous dispersion of claim 4 wherein the paper sizing compound is a cellulose reactive size selected from the group consisting of ketene dimers, ketene multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms.

15. The aqueous dispersion of claim 4 wherein the paper sizing compound comprises alkyl ketene dimer or multimer.

16. The aqueous dispersion of claim 4 wherein the paper sizing compound comprises alkyl ketene dimer or multimer having the structure of formula (1):

(1)

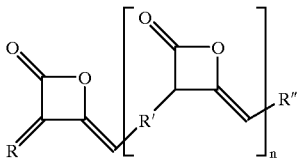

wherein n is an integer of 0 to about 20, R and R", which may be the same or different, are saturated or unsaturated straight chain or branched alkyl or alkylene groups having 6 to 24 carbon atoms; and R' is a saturated or unsaturated straight chain or branched alkylene group having from about 2 to about 40 carbon atoms.

17. The aqueous dispersion of claim 16 wherein R and R" have from 10 to 20 carbon atoms and R' has from 4 to 8 or from 28 to 40 carbon atoms.

18. The aqueous dispersion of claim 16 wherein R and R" have from 14 to 16 carbon atoms and R' has from 4 to 8 or from 28 to 40 carbon atoms.

19. The aqueous dispersion of claim 4 wherein the paper sizing comnpound is a cellulose non-reactive size selected from the group consisting of unmodified rosin, fortitied rosin, rosin ester, hydrogenated rosin, extended rosin, wax, and hydrocarbon resins.

20. The aqueous dispersion of claim 4 further comprising starch.

21. The aqueous dispersion of claim 4 further comprising starch at a level up to about 20 wt. % on a dry basis based on the total weight of the dispersion.

22. The aqueous dispersion of claim 4 further comprising starch at a level of from about 0.1 to about 5 wt. % based on the total weight of the dispersion.

23. The aqueous dispersion of claim 4 further comprising starch at a level of from about 0.3 to about 3 wt. % based on the total weight of the dispersion.

24. The aqueous dispersion of claim 4 containing the paper sizing compound at a level of from about 1 to about 50 wt. % based on the total weight of the dispersion.

25. The aqueous dispersion of claim 4 containing the paper sizing compound at a level of from about 5 to about 20 wt. % based on the total weight of the dispersion.

26. The aqueous dispersion of claim 4 containing the gemini surfactant at a level of from about 0.0001 to about 20 wt. % based on the total weight of the dispersion.

27. The aqueous dispersion of claim 4 containing the gemini surfactant at a level of from about 0.001 to about 10 wt. % based on the total weight of the dispersion.

28. The aqueous dispersion of claim 4 containing the gemini surfactant at a level of from about 0.01 to about 5 wt. % based on the total weight of the dispersion.

29. The aqueous dispersion of claim 4 containing the gemini surfactant at a level of from about 0.1 to about 3 wt. % based on the total weight of the dispersion.

30. The aqueous dispersion of claim 4 wherein the gemini surfactant comprises material of formula:

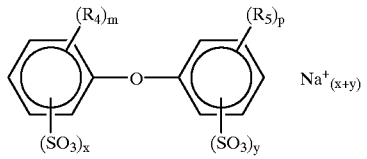

wherein $R_4$ and $R_5$ are $C_1$–$C_{30}$ alkyl, m and p are 0, 1 or 2, m+p is 2, x and y are 0 or 1 and x+y is or 2.

31. The aqueous dispersion of claim 4 wherein the gemini surfactant has a formula selected from the group consisting of:

(3)

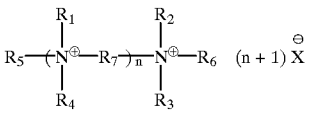

-continued (4)

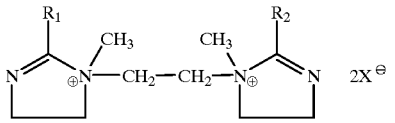

(5)

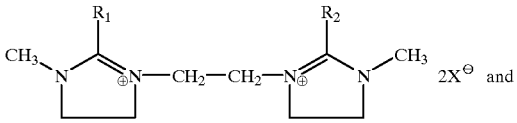

and (6)

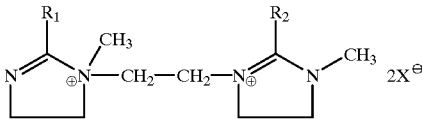

where $R_1$ is a $C_{10}$ to $C_{30}$ alkyl, alkenyl, cycloalkyl, alkaryl or aralkyl group, $R_2$, $R_3$, $R_4$, $R_5$ and $R_6$, which may be the same or different, are $C_1$ to $C_{30}$ alkyl, alkenyl, cycloalkyl alkaryl or aralkyl groups; $R_7$ is a $C_1$ to $C_{30}$ alkylene, alkenylene, cycloalkylene, alkarylene, or aralkylene group, or the hydroxide, acyloxy, chloride or bromide substitution products thereof; n is from 1 to 15; and X is an anion selected from the group consisting of chloride, fluoride, bromide, nitrate, sulfate and alkyl sulfonate.

32. The aqueous dispersion of claim 31 wherein the gemini surfactant comprises a material of formula (3).

33. The aqueous dispersion of claim 31 wherein the gemini surfactant comprises a material of formula (3) where n is 1, $R_7$ is 2-hydroxypropylene, $R_1$ and $R_2$ are $C_{10}$ to $C_{30}$ alkyl groups and $R_3$, $R_4$, $R_5$ and $R_6$ are methyl groups.

34. The aqueous dispersion of claim 31 wherein the gemini surfactant comprises a material of formula (3) where n is 1, $R_7$ is 2-hydroxypropylene, $R_1$ and $R_2$ are $C_{18}$ alkyl groups and $R_3$, $R_4$, $R_5$ and $R_6$ are methyl groups.

35. The aqueous dispersion of claim 31 wherein the gemini surfactant comprises a material of formula (3) where n is 1, $R_7$ is trimethylene, $R_1$ is a mixture of $C_{14}$ to $C_{18}$ alkyl groups and $R_2$, $R_3$, $R_4$, $R_5$ and $R_6$ are methyl groups.

36. The aqueous dispersion of claim 4 wherein the gemini surfactant comprises material of formula (3) and the paper sizing compound is at least one material selected from the group consisting of cellulose reactive sizes and cellulose non-reactive sizes.

37. The aqueous dispersion of claim 4 wherein the gemini surfactant comprises material of formula (9) and the paper sizing compound is a cellulose reactive size selected from the group consisting of ketene dimers, ketene multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms.

38. The aqueous dispersion of claim 4 wherein the gemini surfactant comprises material of formula (9) present at a level of from about 0.0001 to about 20 wt. % based on the total weight of the dispersion, and the paper sizing compound is at least one material selected from the group consisting of cellulose reactive sizes and cellulose non-reactive sizes present at a level of from about 1 to about 50 wt. % based on the total weight of the dispersion.

39. The aqueous dispersion of claim 4 wherein the gemini surfactant comprises material of formula (3) where n is 1, $R_7$ is 2-hydroxypropylene, $R_1$ and $R_2$ are $C_{10}$ to $C_{30}$ alkyl groups and $R_3$, $R_4$, $R_5$ and $R_6$ are methyl groups, and the paper sizing compound is at least one material selected from the group consisting of cellulose reactive sizes and cellulose non-reactive sizes.

40. The aqueous dispersion of claim 4 wherein the gemini surfactant comprises material of formula (3) where n is 1, $R_7$ is 2-hydroxypropylene, $R_1$ and $R_2$ are $C_{10}$ to $C_{30}$ alkyl groups and $R_3$, $R_4$, $R_5$ and $R_6$ are methyl groups, the paper sizing compound comprises alkyl ketene dimer or multimer, and wherein the gemini surfactant is present at a level of from about 0.0001 to about 20 wt. % based on the total weight of the dispersion.

41. A process for preparing sized paper comprising:

a) providing an aqueous paper making pulp suspension;

b) sheeting and at least partially drying the aqueous pulp suspension to obtain paper;

c) applying to the surface of the paper the aqueous dispersion of claim 4; and d) drying to obtain sized paper.

42. The process of claim 41 further comprising the step of adding internal size to the paper making pulp suspension.

43. Paper prepared by the process of claim 41.

44. A process for preparing sized paper comprising:

a) providing an aqueous paper making pulp suspension;

b) adding to the aqueous pulp solution the aqueous dispersion of claim 4; and c) sheeting and drying the aqueous pulp suspension of step (b) to obtain sized paper.

45. Paper prepared by the process of claim 44.

46. A process for preparing sized paper comprising:

a) providing an aqueous paper making pulp suspension;

b) sheeting and at least partially drying the aqueous pulp suspension to obtain paper;

c) applying to the surface of the paper the aqueous dispersion of claim 1; and d) drying to obtain sized paper.

47. The process of claim 46 further comprising the step of adding internal size to the paper making pulp suspension.

48. Paper prepared by the process of claim 46.

49. A process for preparing sized paper comprising:

a) providing an aqueous paper making pulp suspension;

b) adding to the aqueous pulp solution the aqueous dispersion of claim 1; and c) sheeting and drying the aqueous pulp suspension of step (b) to obtain sized paper.

50. Paper prepared by the process of claim 49.

51. An aqueous paper size dispersion comprising:

a) a cellulose-reactive sizing agent, and b) a water-soluble dispersant comprising a di- or polyquaternary amine containing at least one hydrophobic group having from about 10 to about 30 carbon atoms.

52. The aqueous paper size dispersion of claim 51 wherein the water soluble dispersant has a formula selected from the group consisting of:

(3)

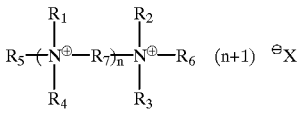

-continued (4)

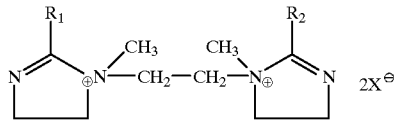

(5)

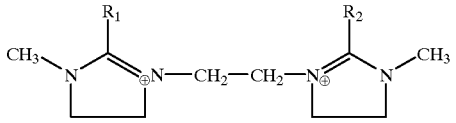

and (6)

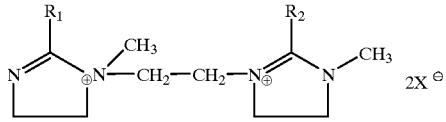

where $R_1$ is a $C_{10}$ to $C_{30}$ akyl, alkenyl, cycloalkyl, alkaryl or aralkyl group, $R_2$, $R_3$, $R_4$, $R_5$ and $R_6$, which may be the same or different, are $C_1$ to $C_{30}$ akyl, alkenyl, cycloalkyl alkaryl or aralkyl groups; $R_7$ is a $C_1$ to $C_{30}$ alkylene, alkenylene, cycloalkylene, alkarylene, or aralkylene group, or the hydroxide, acyloxy, chloride or bromide substitution products thereof; n is from 1 to 15; and X is an anion selected from the group consisting of chloride, fluoride, bromide, nitrate, sulfate and alkyl sulfonate.

53. The aqueous paper size dispersion of claim 51 wherein the water soluble dispersant has the formula (8):

(8)

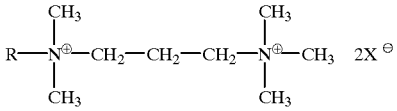

where R is a $C_{14}$–$C_{18}$ alkyl group and X is an anion selected from the group consisting of chloride, fluoride, bromide, nitrate and alkyl sulfonate.

* * * * *